US005492324A

United States Patent [19]

Hagey

[11] Patent Number: 5,492,324

[45] Date of Patent: Feb. 20, 1996

[54] TENNIS RACKET WITH ENHANCED HANDLE KIT

[76] Inventor: Edward H. Hagey, 3653 Jennifer St., San Diego, Calif. 92117

[21] Appl. No.: 363,606

[22] Filed: Dec. 23, 1994

[51] Int. Cl.[6] ..... A63B 49/08

[52] U.S. Cl. ..... 273/75; 273/73 R; 273/73 J; 273/81 R; 273/81 D

[58] Field of Search ..... 273/73 R, 73 J, 273/75, 81 R, 81 D

[56] References Cited

U.S. PATENT DOCUMENTS

| | | | |
|---|---|---|---|
| 2,031,161 | 2/1936 | Hamel . | |
| 4,213,609 | 7/1980 | Swanson . | |
| 4,355,803 | 10/1982 | Rama | 273/73 J |
| 4,438,925 | 3/1984 | Lindstrom . | |
| 4,545,584 | 10/1985 | Adam | 273/73 J |
| 4,736,950 | 4/1988 | Doyle . | |
| 4,828,261 | 5/1989 | Kleylein . | |
| 5,042,804 | 8/1991 | Uke et al. . | |

FOREIGN PATENT DOCUMENTS

| | | | |
|---|---|---|---|
| 2133294 | 7/1984 | United Kingdom | 273/73 J |

*Primary Examiner*—Raleigh W. Chiu
*Attorney, Agent, or Firm*—Baker, Maxham, Jester & Meador

[57] ABSTRACT

A tennis racket has a racket head and a handle shaft extending from the racket head. The handle shaft has a substantially uniform handle portion including a first width dimension and a substantially uniform first depth dimension. The tennis racket can incorporate an improved tennis racket handle kit. The kit includes a first structure for forming an enlarged handle portion of the handle shaft having a substantially uniform second width dimension that is larger than the first width dimension and a substantially uniform second depth dimension that is substantially equal to the first depth dimension. The kit further includes a second structure for forming a handle transition portion of the handle shaft between the first and second handle portions providing a transition between the first and second width dimensions. A handle cover is used to provide a hand grip.

24 Claims, 14 Drawing Sheets

TENNIS RACKET WITH ENHANCED HANDLE KIT

BACKGROUND OF THE INVENTION

The present invention is directed generally to tennis rackets, and more particularly to the hand grip portion of such instruments.

Tennis rackets are conventionally equipped with a hand grip that is octagonal in shape and sized to support a player's hand(s) for single-handed forehand strokes and single-handed or double-handed backhand strokes. The hand grip of many tennis rackets is formed by wrapping a gripping tape winding around a plastic sleeve that is slidably mounted over the shaft of the racket or formed thereon. The hand grip generally extends for about 7½ inches from the base of the racket shaft and is of uniform dimension throughout its length. The circumferential size of the standard octagonal hand grip for junior to adult tennis rackets typically varies from about 4 inches to about 4⅝ inches.

A disadvantage of conventional tennis racket hand grips is that they do not optimally conform to the configuration of the human hand such that the appreciable inertia generated by swinging the racket is not efficiently resisted by the player in the area of the hand, wrist and forearm. These inertial forces are particularly pronounced in newer rackets having enlarged racket head sizes. Because the size of the hand grip in prior art rackets is generally uniform over the length of the grip, the player's hand is not positioned to fully control such forces.

Accordingly, there is an evident need in the art for a tennis racket and tennis racket grip therefor that overcomes the foregoing disadvantages in a novel and innovative fashion. What is required is a tennis racket in which the effects of inertial forces generated by swinging the racket are minimized by providing an alternative to conventional hand grips of uniform size.

SUMMARY OF THE INVENTION

In accordance with the foregoing objectives, a tennis racket is provided having a racket head and a handle shaft extending from the racket head. The handle shaft has a first handle portion including a first width dimension and a first depth dimension. The tennis racket can incorporate an improved tennis racket handle kit. The kit includes a first structure forming an enlarged second handle portion of the handle shaft having a second width dimension that is larger than the first width dimension and a second depth dimension that is substantially equal to the first depth dimension. The kit may further include a second structure forming a handle transition portion of the handle shaft, between the first and second handle portions, providing a transition between the first and second width dimensions. A handle cover is preferably employed to provide a hand-gripping exterior surface. In various embodiments, the tennis racket handle kit can be employed by tennis racket manufacturers during racket production, by tennis racket sale and repair shops, or by players themselves, as add-on equipment.

BRIEF DESCRIPTION OF THE DRAWINGS

The objects, advantages and features of the present invention will be more clearly understood by reference to the following detailed disclosure and the accompanying drawing in which.

DETAILED DESCRIPTION OF THE PREFERRED EMBODIMENTS

Figure 1:
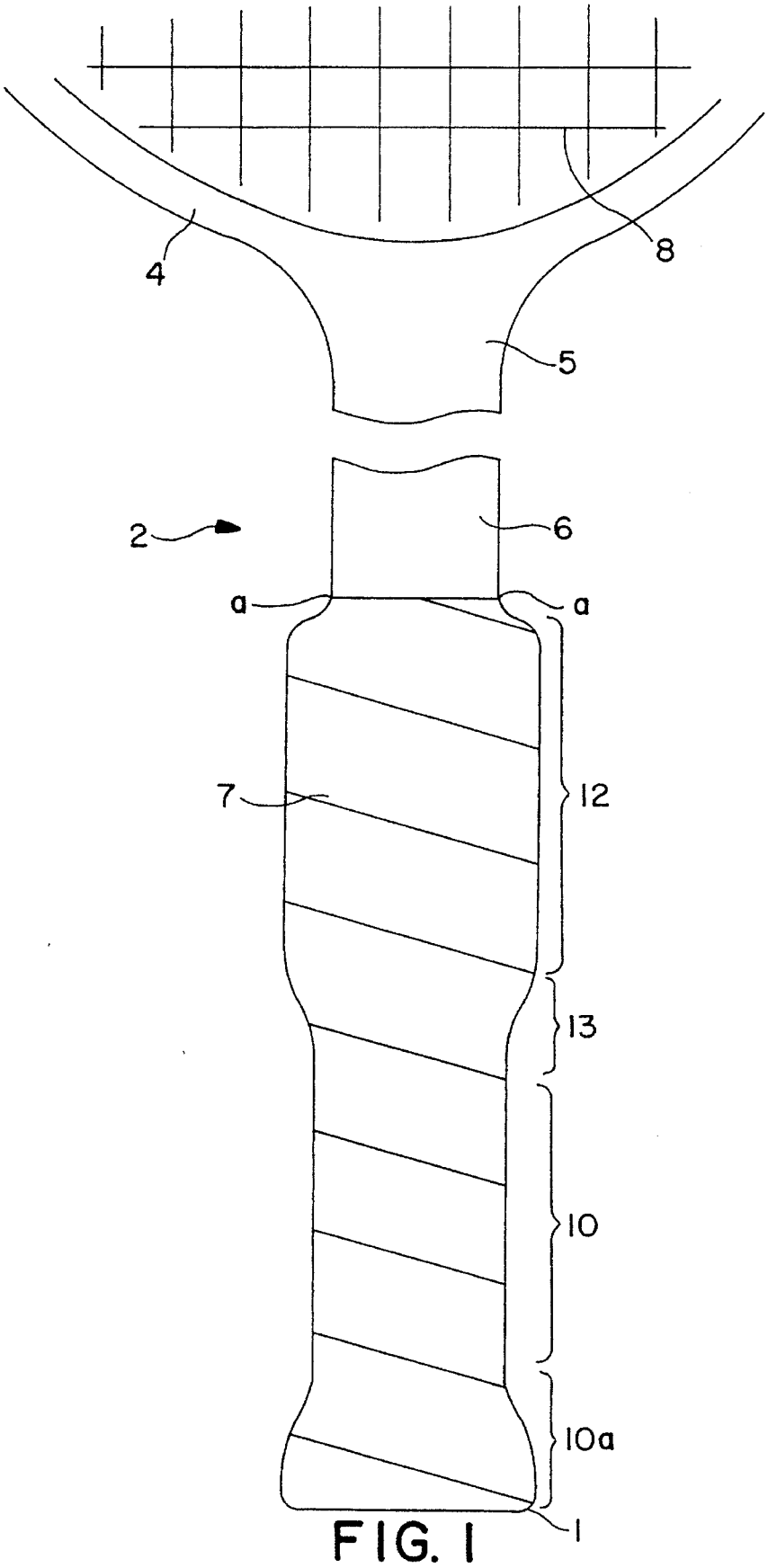
FIG. 1 is a partial plan view of an idealized tennis racket incorporating a tennis racket handle kit constructed in accordance with one aspect of the present invention.
Figures 3, 4:
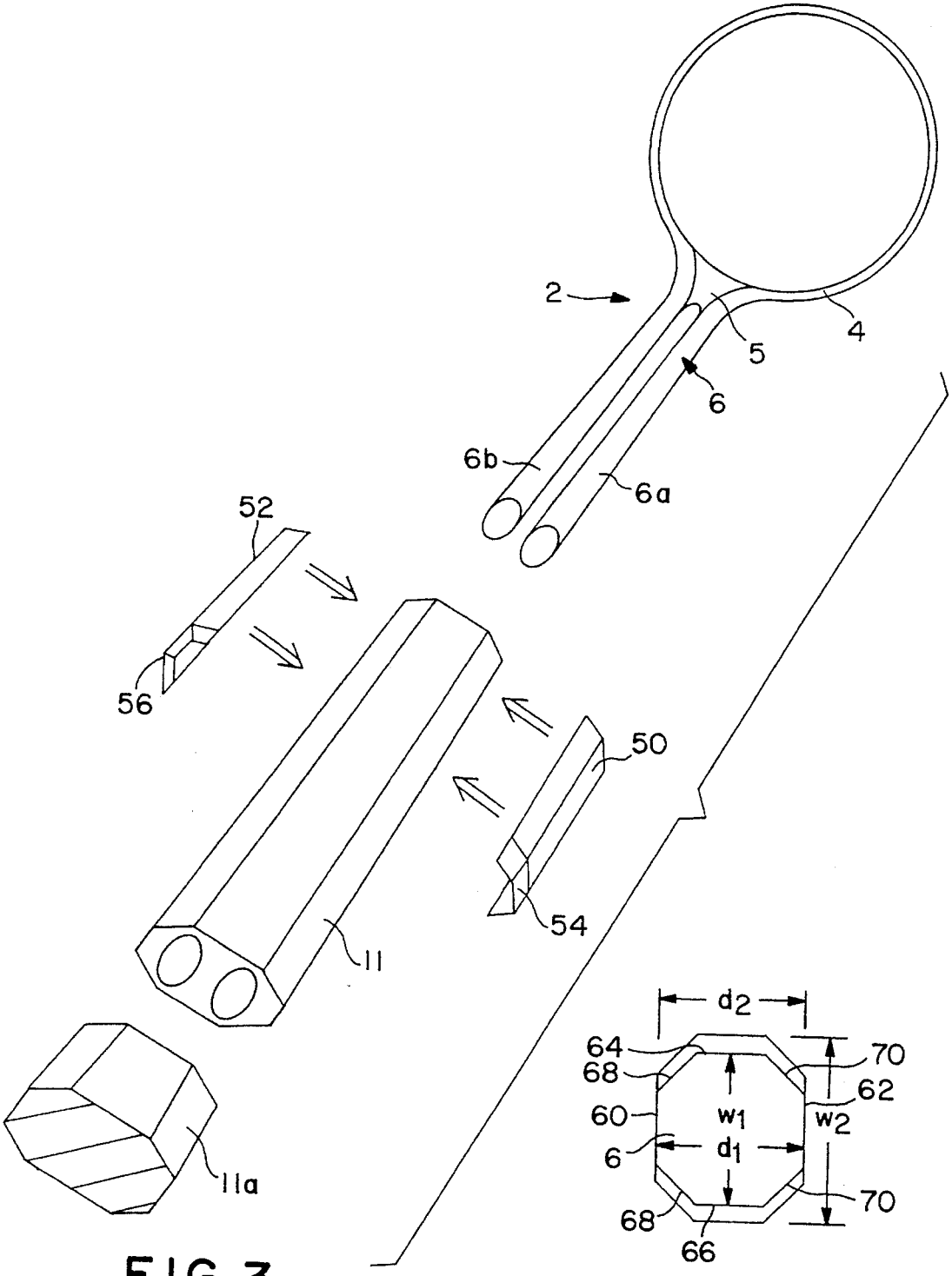
FIG. 3 is an exploded perspective view showing the components that could be used to construct the tennis racket of FIG. 1.
FIG. 4 is a cross-sectional view showing a portion of the handle shaft of the tennis racket of FIG. 1.

Referring now to FIG. 1, a tennis racket 2 has a racket head 4, a throat area 5 and a handle shaft 6 extending from the racket head. The racket head may be of any conventional size and includes the usual gut or synthetic string webbing 8 that provides a resilient striking surface for addressing a tennis ball. The handle shaft 6 is covered by a tape wrapping 7 extending between points "a" and "b" on the handle shaft. The handle shaft 6 further includes a first handle portion 10 that is octagonal in shape, as is conventional. The shape of the handle portion 10 is defined by either the surface of the handle shaft itself, or by a plastic sleeve 11 (see FIG. 3), that is mounted on the handle shaft 6, if one is present. The racket head 4 and the handle shaft 6 can be made from wood, composite fiber material or metal, as is known in the art. As shown in FIG. 4, the handle portion 10 includes a substantially uniform first width dimension w1 and a substantially uniform first depth dimension d1. If a plastic sleeve 11 is used to define the handle portion, it can be configured to provide a slightly flared element 10*a* defined at the base of the handle shaft 10. Alternatively, as is more conventional, the flared element could be provided as a rubber or plastic sleeve 11*a* that mounts over the principal sleeve 11.

Figure 2:
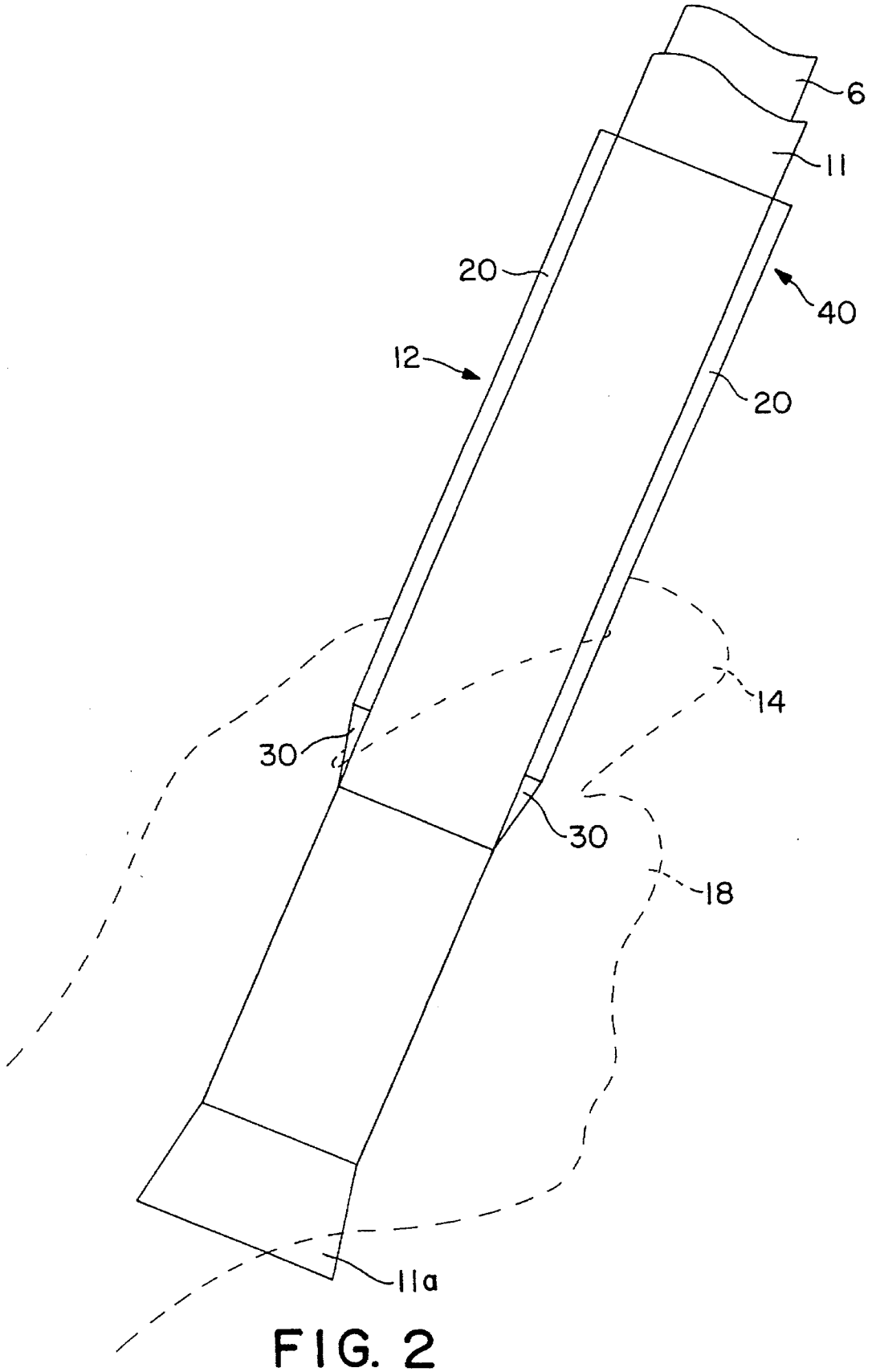
FIG. 2 is a diagrammatic partial perspective view showing the tennis racket of FIG. 1 being gripped by a tennis player.

As shown in FIGS. 1 and 2, the problem of resisting inertial racket forces in order to improve player control over the racket is solved by providing a kit for forming a second, enlarged racket handle portion 12 of the handle shaft 6. The enlarged handle portion 12 allows a tennis player to position the forefinger 14 of the player's hand 16 upwardly and away from the remaining fingers 18. This position provides the player with enhanced control over the movement of the racket during all phases of the game including service, and forehand and backhand ground and overhead strokes.

In order to achieve this intended effect, the enlarged handle grip portion 12 is formed from a handle kit that includes a first structure 20. As shown in FIGS. 2 and 4, the enlarged handle portion 12 has a substantially uniform second width dimension w2 that is larger than the first width dimension w1 and a substantially uniform second depth dimension d2 that is substantially equal to the first depth dimension d1. A second structure 30 (see FIG. 2) is further provided for forming a handle transition portion 13 of the handle shaft, between the first and second handle portions 10 and 12, that tapers between the first and second width dimensions w1 and w2. Any conventional covering, such as the tape wrapping 7 (see FIG. 1), can be provided for covering the first and second structures 20 and 22.

The first enlarged handle portion structure 20 and second handle transition portion structure 30 can be formed in a variety of ways. First, they could be integrally fabricated with the handle shaft 6 during racket manufacture, in which case the handle kit of the present invention would be integrally incorporated into the racket 2 by the manufacturer. This technique could be used for a variety of racket materials including aluminum, resin-impregnated fiber and wood, with the handle kit being formed by appropriate shaping of the handle material during manufacture. Another way to form the enlarged handle structure 20 and second handle transition portion structure 30 would be to integrate these structures as part of the sleeve 11. Still another way to form the structures 20 and 30 would be to provide these structures as a bendable molded rubber piece 40 that would preferably slide over the handle shaft 6, or the sleeve 11 if present, and could be secured thereto using an adhesive. If the structures 20 and 30 are designed as part of the conventional sleeve 11, the sleeve would integrally provide the first handle portion 10 and the enlarged handle portion 12.

Still another way to form the first and second enlarged handle and handle transition portion structures 20 and 30 would be to form these structures as a pair of resilient inserts 50 and 52 mountable on opposing sides of the sleeve 11, as shown in FIG. 3, or the handle shaft 6 itself. FIG. 3 illustrates that the handle shaft 6 of the tennis racket 2 may be formed from a pair of tubes 6*a* and 6*b* when the racket is made from extruded metal material. The tubes 6*a* and 6*b* are mounted within the sleeve 11. The inserts 50 and 52 could be substantially rectangular strips having a thickness "t" providing an increase in size between the first width dimension w1 and the second width dimension w2, with the increase in size being substantially equal to "2×t." The inserts 50 and 52 include tapered end portions 54 and 56, respectively, that provide the second structure 22 forming the handle transition portion. Advantageously, the first and second structures 20 and 22 can be formed as one or more of the inserts 50 and 52 mounted on opposing sides of the sleeve 11 or handle shaft 6. For example, two or more inserts 50 and 52 could be mounted on each of the opposing sides of the sleeve 11 or handle shaft 6, the number of inserts being selected to provide a total increased thickness between the first width dimension w1 and the second width dimension w2 of "T=2 [t1+t2 . . . +tn]" where "n" is the number of inserts on a side and "t" is the thickness of each insert.

Figure 6:
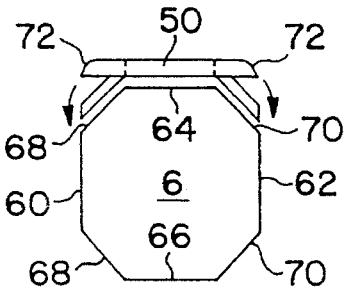
FIG. 6 is a cross-sectional view showing another embodiment of a tennis racket handle kit insert member.

As shown in FIGS. 4 and 6, the sleeve 11 and/or the handle shaft 6 include a pair of racket handle side walls 60 and 62, a pair of racket handle end walls 64 and 66 substantially perpendicular to the side walls, and two pairs of racket handle angled walls 68 and 70 joining the side walls and end walls so as to form a octagonal cross section.

Figure 5:
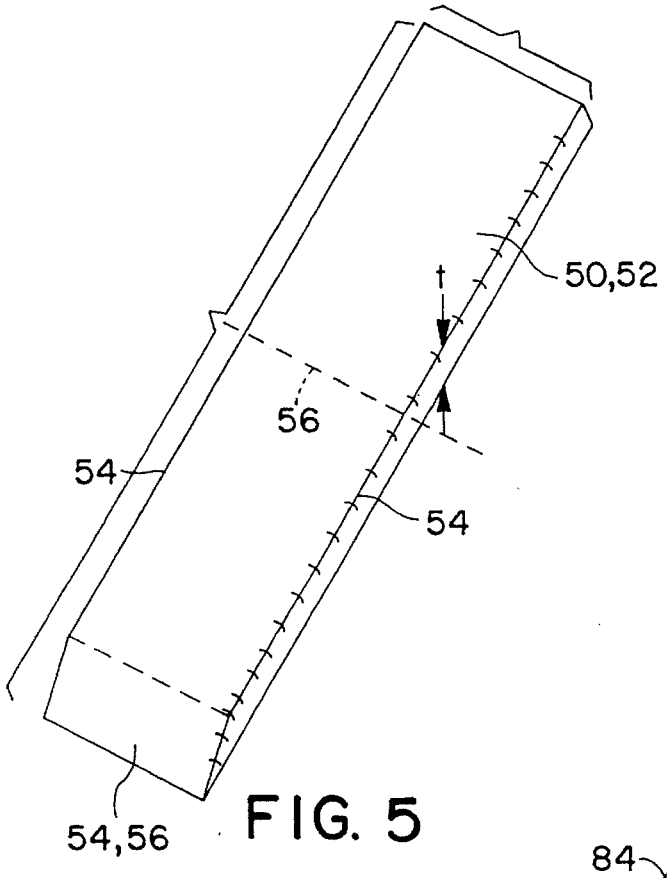
FIG. 5 is a perspective view of one embodiment of a tennis racket handle kit insert member.

As shown in FIG. 5, the inserts 50 and 52 are generally rectangular strips. They can be sized to have a width that is substantially equal to the width of the end walls 64 and 66. In that case, rounded edges 54 can be provided for a comfortable grip. Alternatively, as shown in FIG. 6, the inserts 50 and 52 could be formed as bendable strips having a width that is substantially equal to the width of the end walls 64 and 66 plus the width of two of the angled walls 68 and 70. In that case, the bendable strips 50 and 52 would have angled edges 72 (e.g. 45°) configured to line up with the racket handle side walls 60 and 62 when the strips are placed over the end walls 64, 66 and angled walls 68, 70. Advantageously, the inserts 50 and 52 can be provided with one or more pre-scored "cut" lines 56 so that the inserts can be sized to the player's preference. In this way, the length of the enlarged handle portion 12 can be variably selected, e.g., for single-handed or two-handed play.

Figure 7:
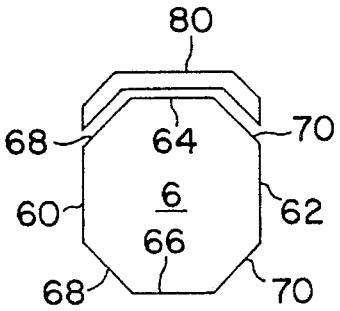
FIG. 7 is a cross-sectional view showing still another embodiment of a tennis racket handle kit insert member.
Figure 8:
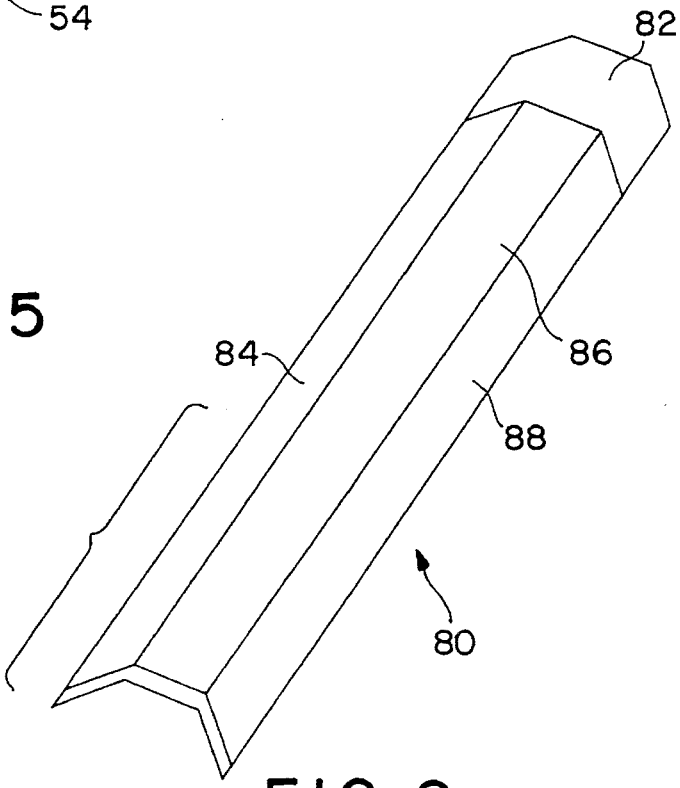
FIG. 8 is a perspective view of the tennis racket handle kit insert member of FIG. 7.

Referring now to FIGS. 7 and 8, the first and second structures 20 and 22 could be formed as one or more pairs of flexible pre-molded inserts 80. Each of the inserts 80 has three walls 84, 86 and 88 configured to mount on one of the racket handle end walls 64 or 66, and the two adjacent angled walls thereof 68 and 70. The inserts 80 have angled edges 90 (45°) configured to line up with the racket handle side walls 60 and 62 when the inserts are placed over the end walls 64, 66 and adjacent angled walls 68, 70. The inserts 80 further include a tapered end portion 82 that provides the handle transition portion of the handle shaft. The inserts 80 are preferably attached to the sleeve 11 or the handle shaft 6 using adhesive. Score lines could be provided for cutting the inserts 80 to length.

As previously described, the tennis racket handle kit of the present invention could be installed and incorporated by the tennis racket manufacturer as part of the manufacturing process. Alternatively, the kit could be separately sold so that a tennis shop, or perhaps a tennis racket owner, could modify an existing conventional tennis racket. In that case, the kit would consist of a set of any of the above-described sleeve or insert structures. In the latter case, the inserts would be mountable on opposing sides of the sleeve 11 or the handle shaft 6. The inserts would have selected thicknesses and could be arranged in layers of one or more inserts on each of the opposing sides of the sleeve 11 or handle shaft 6 to provide an increase in size between the first width dimension w1 and the second width dimension w2, the increase in size being substantially equal to the combined thicknesses of the inserts. A subsequent step in the fabrication of an enlarged racket handle using any of the foregoing kits would include covering a portion of the handle shaft, including the inserts, with a tape wrapping such as the wrapping 7, in order to form a hand grip.

Considering now the tennis racket handle kits of FIGS. 1 and 2, in which w1 and w2 are substantially uniform over the length of the handle, it will be appreciated that the increase in size, shape and position of the enlarged handle and handle transition portions of the tennis racket handle can be widely varied. For a handle that is 7½ inches long, for example, the tennis racket handle kit of the present invention could be configured so that the base end of the handle transition portion is located about 3½ inches from the base of the handle shaft 6 at point "b." This is the distance at which the V-shaped area between the player's thumb and forefinger would comfortably come to rest on the handle transition portion 13 when the handle is gripped for a normal forehand stroke, as shown in FIG. 2. To accommodate the V-shaped area of the player's hand, the handle transition portion could extend about ¼–¾ inches to the base end of the enlarged handle portion 12. The enlarged handle portion 12 would then extend about 3¼–3¾ inches toward the throat end of the handle shaft to point "a." The total increase in handle width provided by the enlarged handle portion 12 (e.g. w2-w1) could range anywhere from about ¼–1½ inches.

Figure 9A:
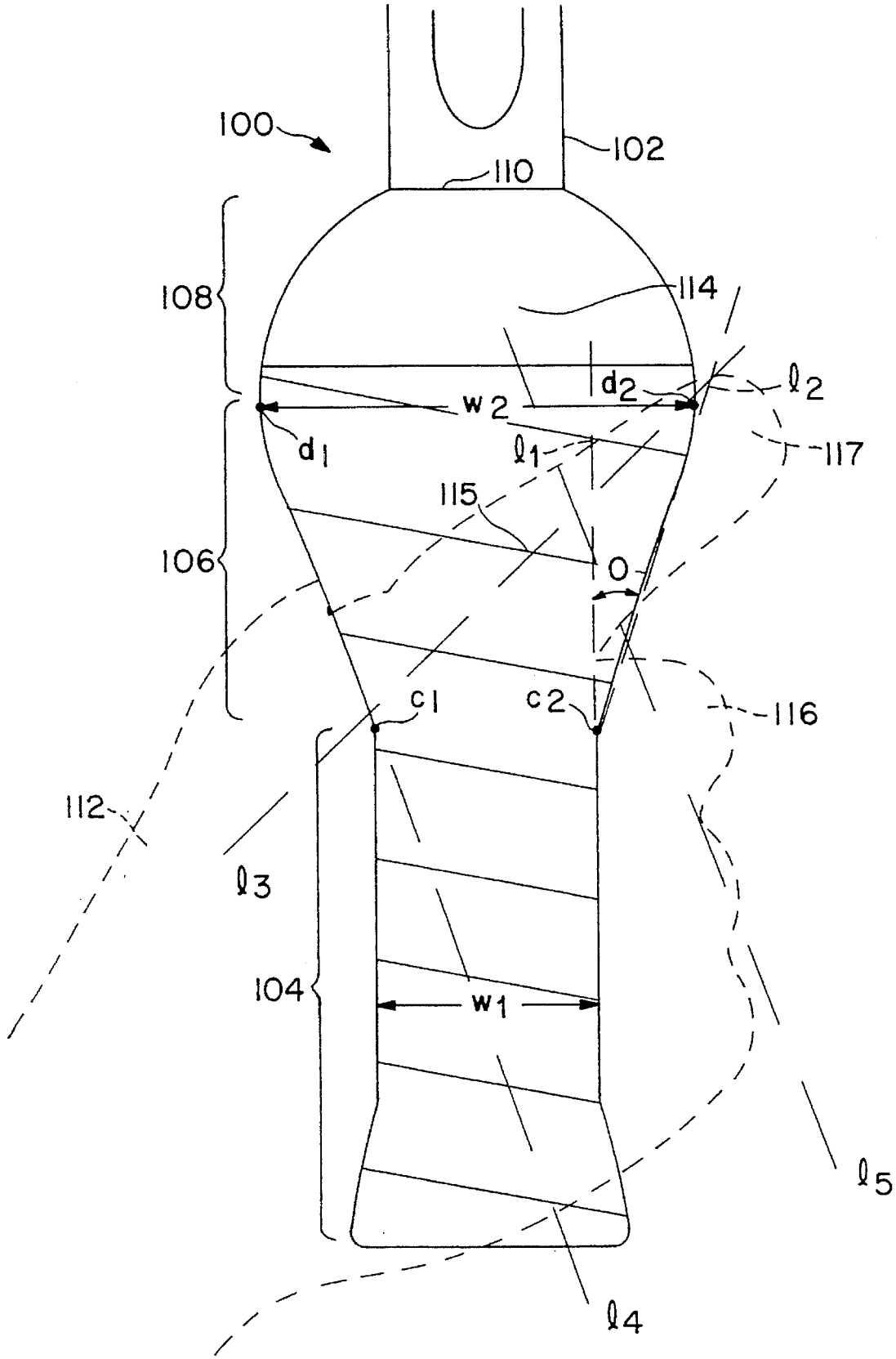
FIG. 9*a* is a partial front view of a novel tennis racket handle configuration which advantageously provides an enlarged handle portion for the placement of names, logos and other advertising indicia.
Figure 9B:
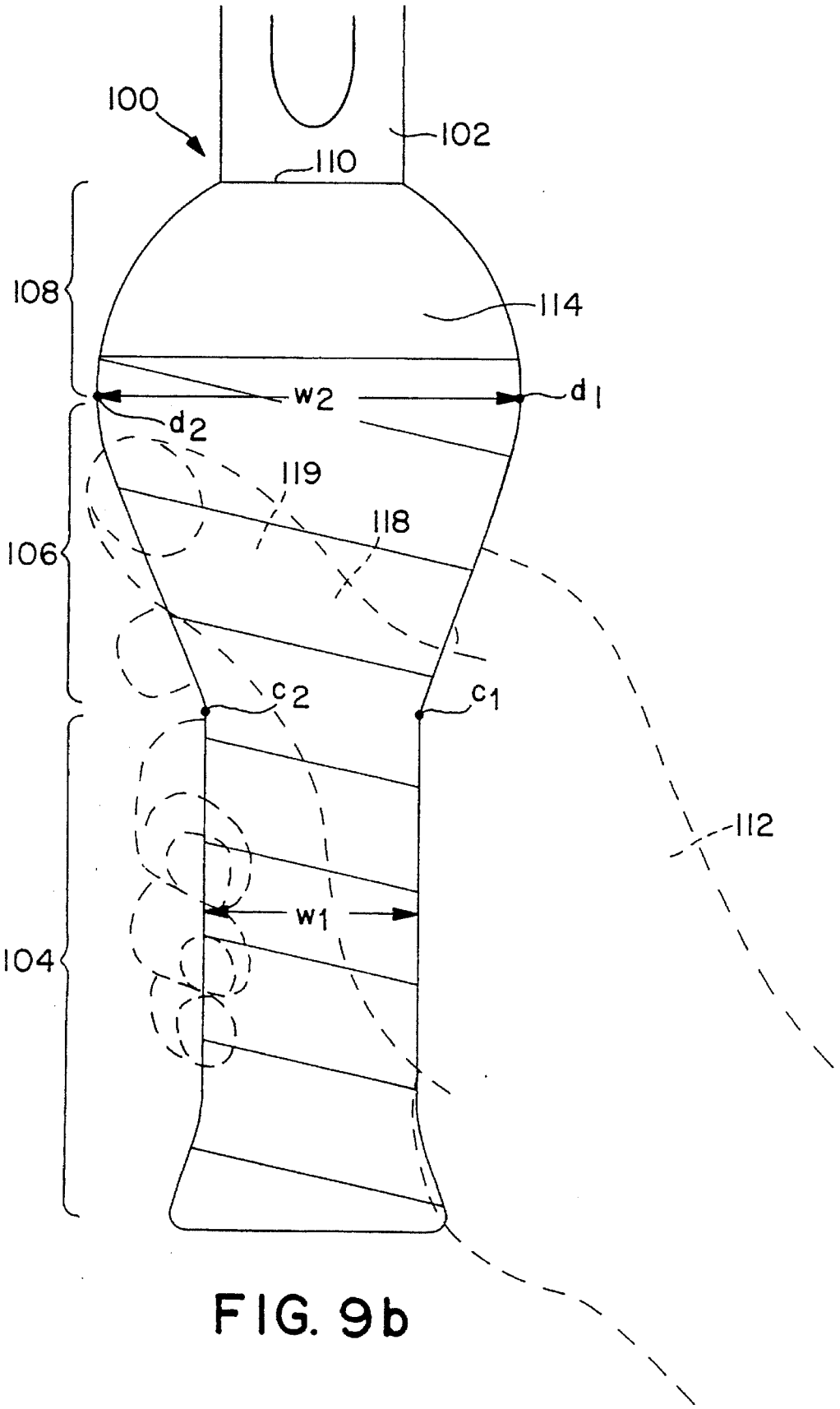
FIG. 9*b* is a partial rear view of the tennis racket handle configuration of FIG. 9*a;*

In the embodiment of FIGS. 9*a* and 9*b*, a tennis racket 100 includes a handle shaft 102 and a first handle portion 104 having a substantially uniform first width dimension w1 and a substantially uniform first depth dimension (not shown). The first handle portion extends to points "c1" and "c2" on each side of the handle. Extending from points "c1" and "c2" is a gently curved handle transition portion 106 which may be formed so as to be substantially in excess of the length of the handle transition portion 13 of the kits shown in FIGS. 1–8. The handle transition portion 106 in FIGS. 9*a* and 9*b* extends from the upper end of the first handle portion 104 at points "c1" and "c2" and extends to the area of the maximum width dimension w2, shown by points "d1" and "d2". In the area of points "c1" and "c2", the handle transition portion 106 has a concave curvature with respect to the player's hand 112. In the area of points "d1" and "d2", the handle transition portion 106 has a convex curvature with respect to the player's hand 112. An enlarged second handle portion 108 extends from points "d1" and "d2" and has a substantially uniform second depth dimension (not shown) which is substantially equal to the first depth dimension of the first handle portion 104, and a maximum width dimension w2 which is substantially larger than the first width dimension w1 of the first handle portion. Because points "d1" and "d2" are the points of maximum width w2, the enlarged handle portion 108 could be partially straight, or could gradually taper inwardly to the upper edge 110 thereof. In FIGS. 9*a* and 9*b*, the enlarged handle portion 108 has a convex curvature relative to the player's hand 112 and tapers inwardly from the points "d1" and "d2" to the upper edge 110. Alternatively, the enlarged handle portion 108 could be concave with respect to the player's hand to provide a "sword" effect. Many other configurations for the enlarged handle portion 108 could also be provided.

Advantageously, the enlarged second handle portion 108, either alone or in combination with the handle transition portion 106, provides a wide, flat area 114, as shown in FIGS. 9*a* and 9*b*, which can be used as an advertising area for displaying names, logos and other advertising indicia for manufacturers, sponsors and the like. For example, FIGS. 9*a* and 9*b* show the trademark "TOMAHAWK" appearing in the advertising area 114. As will be described, it is desirable, but not mandatory, in providing the advertising area 114, to maintain the depth dimension of the handle portion 108 relatively uniform to provide a substantially flat area extending across the width w2 for printing, the substantially flat area preferably being at least as wide as the width w1.

In the configuration of FIGS. 9*a* and 9*b*, points "c1" and "c2" would typically be located about 3½ inches from the base of the handle shaft 102 so that the V-shaped area of the player's hand 112 can be brought comfortably into engagement with the bottom of the handle transition portion 106 when the handle is gripped for a normal forehand stroke. The length of the handle transition portion 106 in the FIGS. 9*a* and 9*b* configuration preferably ranges from about 1–3½ inches, while the enlarged handle portion 108 can range from about ½–3 inches. The increase in handle width provided by the enlarged handle and handle transition portions (i.e. w2-w1) preferably ranges from about 1–1½ inches. The angle θ, whose origin is at either of the points "c1" and "c2," and which measures the angle made by a line extending between the points "c1," "d1," or "c2," "d2," and a line "1" representing an extension of either of the sides of the first handle portion 104, preferably ranges between about 10–60 degrees and, is optimally about 17 degrees. In most cases, the handle transition portion 106 and the enlarged handle portion 108 will be sized so that the player's index finger 115 can be angled upwardly and away from the remaining fingers 116 on a line generally extending from the points "c1" or "c2" on one side of the handle shaft 102, to the points "d2" or "d1," respectively, on the other side of the handle shaft. During forehand strokes, the edge of the racket handle in the vicinity of the points "d1" or "d2" preferably lies under the area of the player's index finger extending between the first joint and the end of the finger. Alternatively, the entire index finger could be positioned to lie across the face of the racket handle between the points "c1" or "c2" and the interior areas of the handle transition portion 106 and the enlarged handle portion 108. During backhand strokes, the edge of the racket handle in the vicinity of the points "d1" or "d2" preferably lies under the area of the player's thumb 118 extending between the first thumb joint 119 and the end of the thumb. Alternatively, the entire thumb could be positioned to lie across the face of the racket handle between the points "c1" or "c2" and the interior areas of the handle transition portion 106 and the enlarged handle portion 108.

To provide the advantages of an enlarged handle portion, the handle transition portion 106 and the enlarged handle portion 108 should thus be sized and configured so that the area on one side of the handle that is adjacent to the points "c1" and "c2" will provide a comfortable surface, preferably slightly concave in shape, against which the V-shaped area of the player's hand between the thumb and forefinger 117 can comfortably rest, while the area adjacent the points "d1" and "d2" should be configured to engage portions of the player's index finger or thumb in a comfortable fashion by making that area flat or slightly convex in shape. Alternatively, as previously indicated, a sharp concave transition could be provided at the points "d1" and "d2" to support the first or second joint of the player's index finger to provide a "sword effect" for use during forehand strokes. As shown in FIG. 9*a*, the angle between points "c1," "d1" or "c2," "d2" on each side of the handle is preferably substantially parallel to a line extending generally through the knuckles of the player's hand 112, thus orienting the hand in the manner shown in FIG. 9*a* during forehand strokes, and allowing the forefinger 117 to naturally extend from the points "c1" or "c2" on one side of the handle to the points "d2" or "d1", respectively, on the other side of the handle. Because points "d1" and "d2" represent a widened grip area providing purchase points for the thumb and forefinger, the player's fingers tend to spread apart in a manner which has been determined to provide increased degrees of controlled power during both forehand and backhand strokes.

Figure 10:
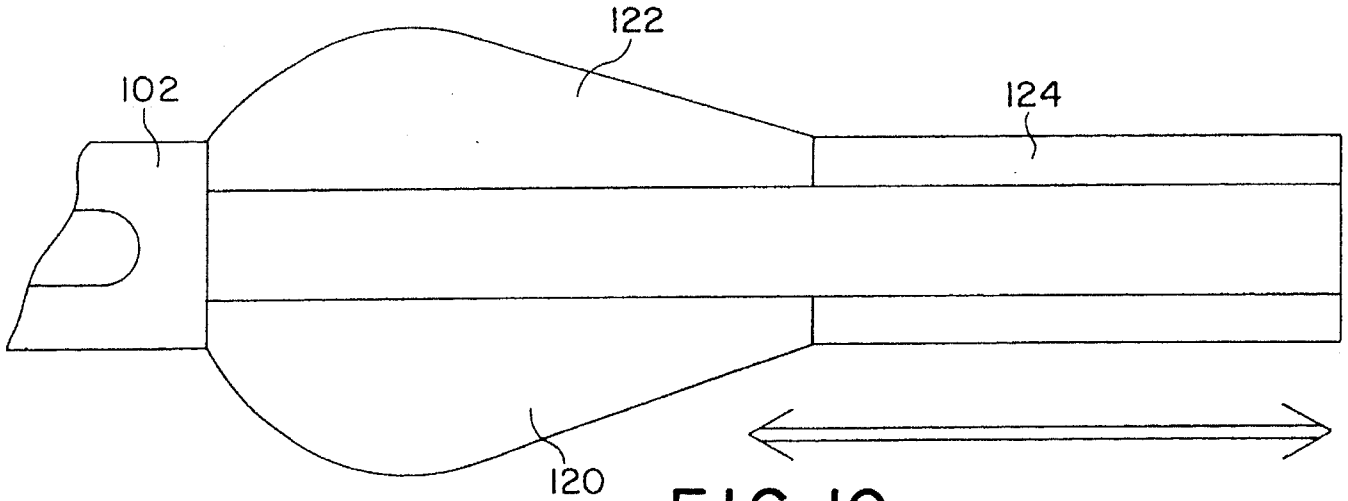
FIG. 10 is a partial plan view showing a tennis racket handle kit useful for fabricating the handle configuration of FIGS. 9*a* and 9*b*, and many other handle shapes.
Figure 12:
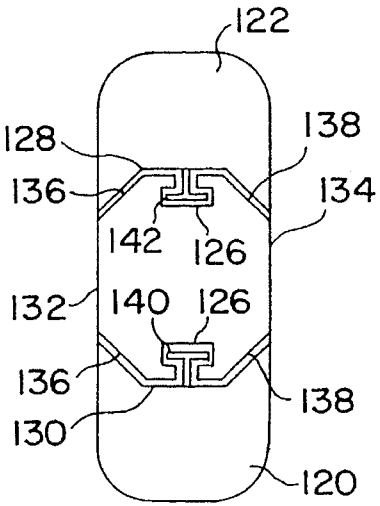
FIG. 12 is a cross-sectional view of the tennis racket handle kit of FIGS. 9*a* and 9*b;*
Figure 11:
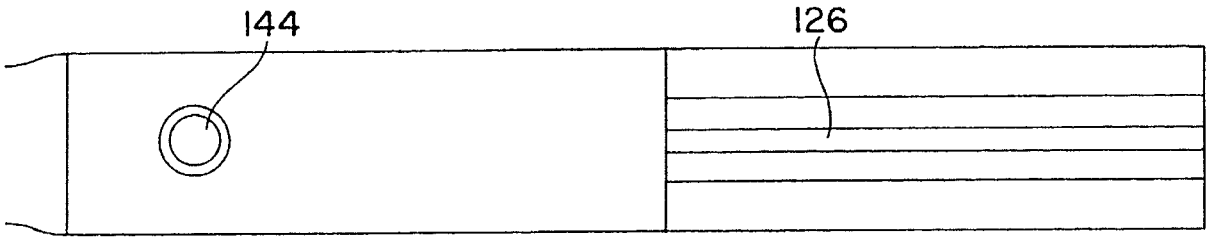
FIG. 11 is a partial side view of the tennis racket handle kit of FIGS. 9*a* and 9*b;*

Referring now to FIG. 10, the tennis racket handle kit of FIGS. 9*a* and 9*b* could be adapted for use by a manufacturer using a pair of rigid plastic inserts 120 and 122 mounted on a specially designed handle shaft 124. The handle shaft 124 can be octagonal in shape like other handle shafts but it is distinguished therefrom by the inclusion of t-shaped tracks 126 on opposing sides thereof. More specifically, as shown in FIG. 12, the handle shaft 124 includes a pair of end walls 128 and 130 in which the tracks 126 are formed. The handle shaft 124 also includes a pair of side walls 132 and 134, and two pairs of angled walls 136 and 138 extending between the side and end walls. The inserts 120 and 122 are sized and configured to mate with the end walls 128 and 130, and the angled walls 136 and 138, and are further configured with t-shaped guides 140 and 142, respectively, which slidably mount in the tracks 126 of the handle shaft 124. Thus, the inserts 120 and 122 can be slidably adjusted along the lower handle shaft 124 for positioning in accordance with a player's preference. When a preferred position is selected, the inserts 120 and 122 can be secured to the handle shaft 124 using appropriate fasteners, such as the screws 144 which engage one of the end walls 128, 130 and secure the inserts 140, 142 against the inner portion of the track 126 of the handle shaft 124. The implementation of the tennis racket handle kit of FIGS. 10–12 is completed by wrapping conventional grip material over the inserts 120, 122 and the remaining length of the handle shaft 124.

Figure 13:
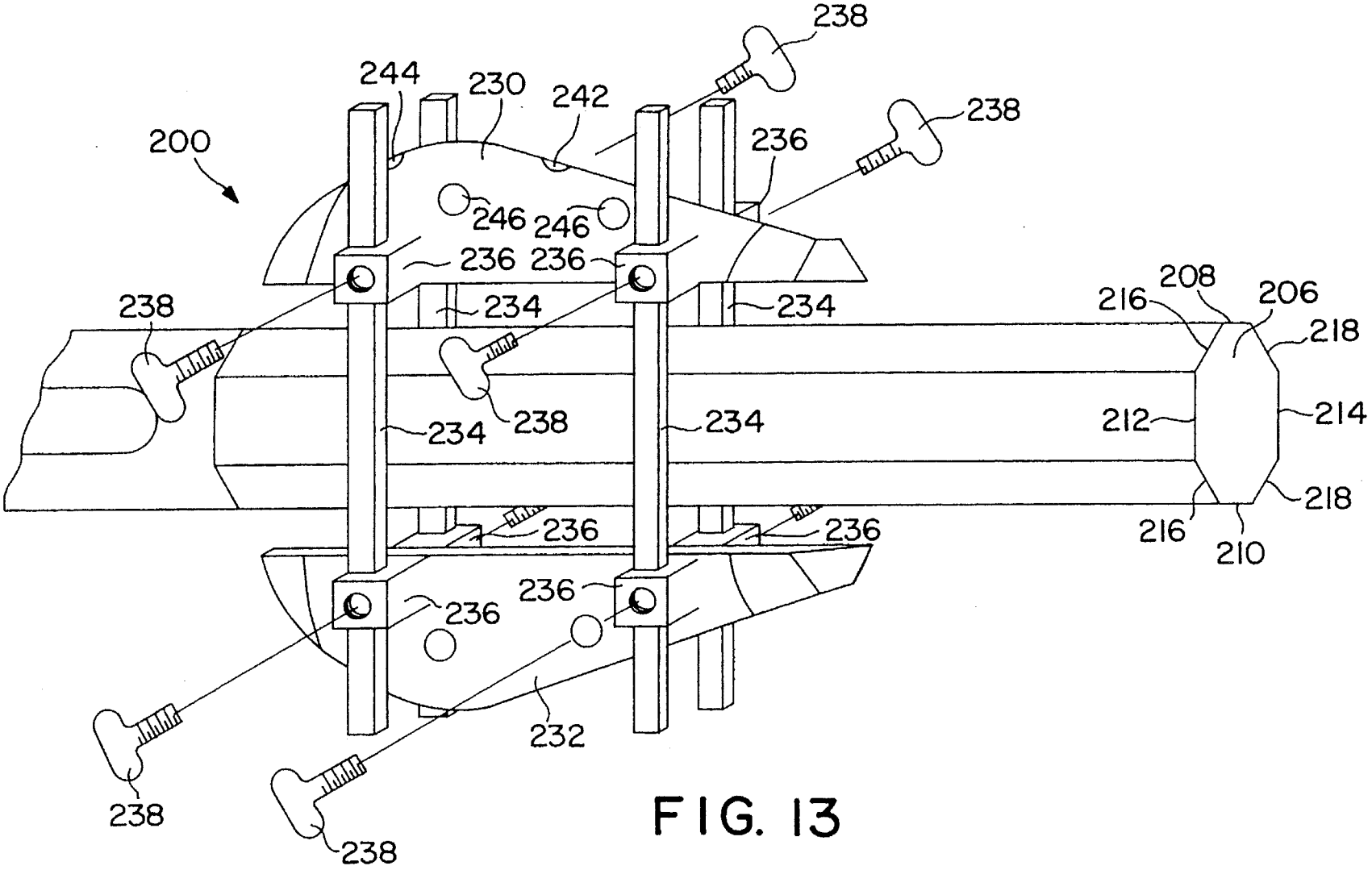
FIG. 13 is a partial perspective view of still another embodiment of a tennis racket handle kit useful for fabricating the handle configuration of FIGS. 9*a* and 9*b*, and many other handle shapes.
Figure 14:
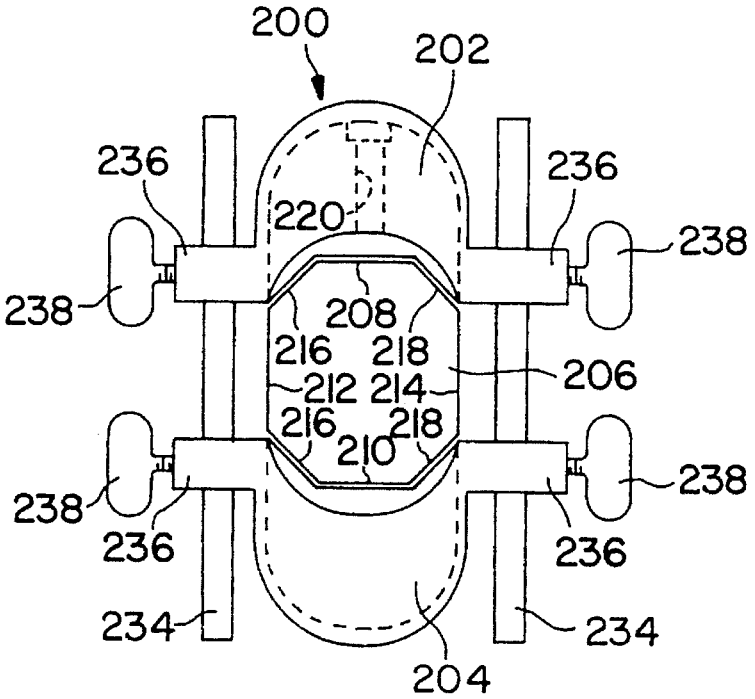
FIG. 14 is a cross-sectional view of the tennis racket handle kit of FIG. 13.

Turning now to FIGS. 13–16, the tennis racket handle configuration of FIGS. 9*a* and 9*b* is shown in a kit which could be used by tennis shops and/or tennis players to modify an existing tennis racket having a conventional handle. FIG. 13 illustrates the use of a clamping jig 200 which is intended to hold a pair of inserts 202 and 204 (see FIG. 14), against the walls of a tennis racket handle shaft 206 so that the handle shaft can be drilled. The handle shaft 206 includes a pair of end walls 208 and 210, a pair of side walls 212 and 214, and pairs of angled walls 216 and 218 extending between the side and end walls. The inserts 202 and 204 may be of the same shape as the inserts 120 and 122 of FIGS. 10–12, except that they lack the guide members 140 and 142. Moreover, the inserts 202 and 204 are pre-drilled in order to receive a fastener for attachment to the handle shaft 206. FIG. 14 illustrates pre-drilled holes 220 in the insert 202. Similar pre-drilled holes are provided in the insert 204 but are preferably larger in diameter to allow for drill angle tolerance as the drill passes through both inserts and the handle shaft 206.

Figure 15:
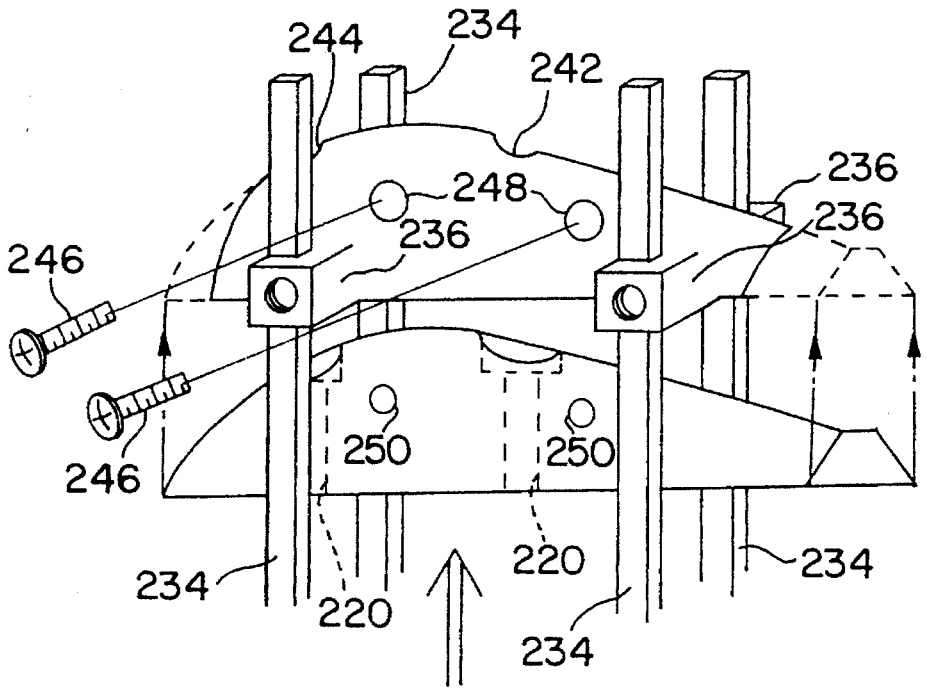
FIG. 15 is a detailed perspective view of the tennis racket handle kit of FIG. 13.

The drill jig assembly 200 includes a pair of insert cover members 230 and 232 which are sized and configured to allow the inserts 202 and 204 to be placed snugly therein such that the inserts are at least partially covered by the cover members during drilling. The cover members 230 and 232 themselves are connected to one another via four guide bars 234, which extend through lugs 236 formed on the sides of each cover member. The cover members 230 and 232 can be slidably positioned toward one another along the guide bars 234 until the inserts 202 and 204 are snugly positioned against the end walls 208, 210 and the angled walls 216, 218 of the handle shaft 206. The drill jig 200 is then secured in place using a plurality of thumb screws 238 which threadably extend into the sides of the lugs 236 until they contact the guide bars 234. In alternative construction, the guide bars 234 could be replaced with a conventional bolt and nut arrangement. As shown in FIG. 14, with the drill jig 200 in place holding the inserts 202 and 204 snugly against the handle shaft 206, a drill bit (not shown) can be inserted through the pre-drilled guide holes 220 in the insert 202, and the handle shaft 206 can be drilled in one or more places corresponding to the location and number of the guide holes. As shown in FIGS. 13 and 15, there are preferably at least two drill holes, 242 and 244, formed in each cover member 230 and 232. Additional securement of the inserts 202 and 204 can be provided using set screws 246, which extend through sides holes 248 in the cover members 230 and 232 and engage the inserts at indentations 250 formed therein.

Figure 16:
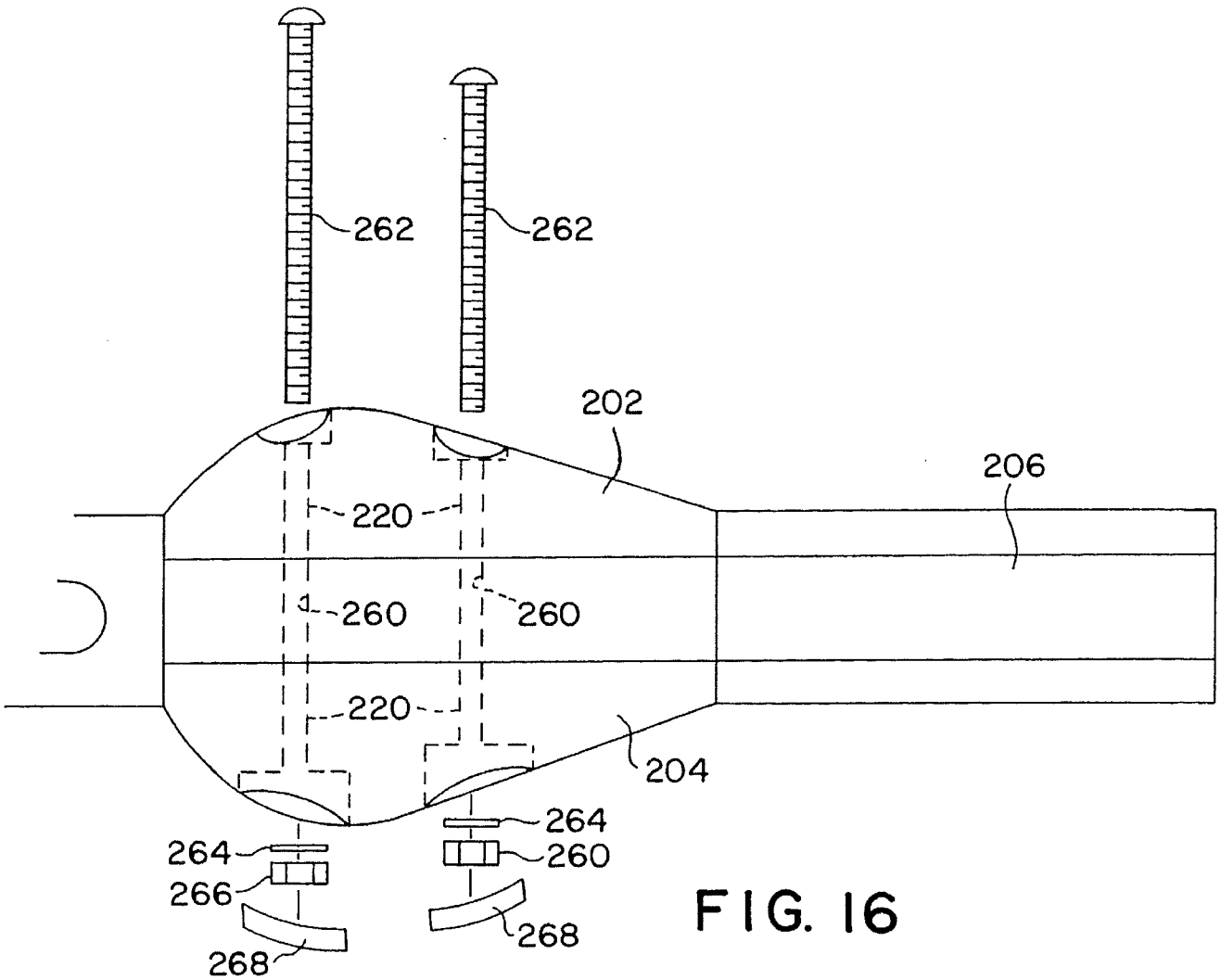
FIG. 16 is a partial side view of the tennis racket handle kit of FIG. 13.

Turning now to FIG. 16, once appropriate holes 260 are drilled through the handle shaft 206, the drill jig 200 can be removed and the inserts 202 and 204 can be secured to the handle shaft using conventional fasteners such as the combination of bolts 262, washers 264 and nuts 266 shown in the Figure. A pair of resilient protective caps 268 can be placed over the nuts 260 for player comfort. Preferably, the inserts 202 and 204 are countersunk so that the fasteners do not protrude beyond the exterior surfaces of the inserts. The implementation of the tennis racket handle kit of FIGS. 13–16 is completed by wrapping the inserts 202, 204, and the remainder of the handle shaft 206, with appropriate gripping tape.

Figure 17:
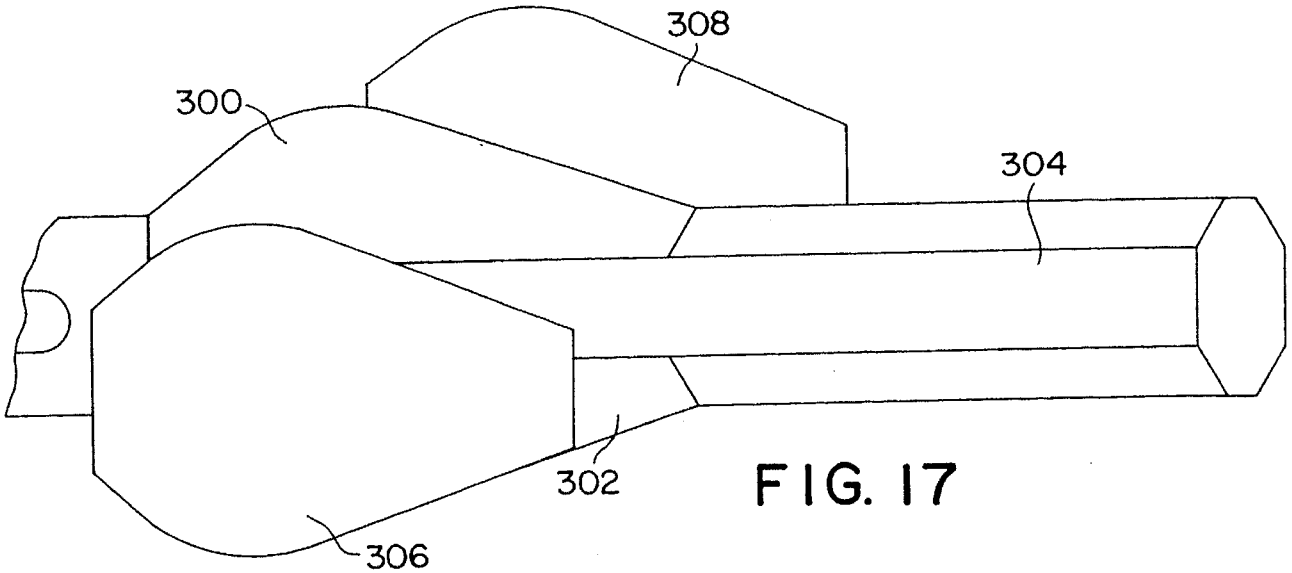
FIG. 17 is a partial perspective view showing still another embodiment of a tennis racket handle kit useful for fabricating the handle configuration of FIGS. 9*a* and 9*b*, and many other handle shapes.
Figure 18:
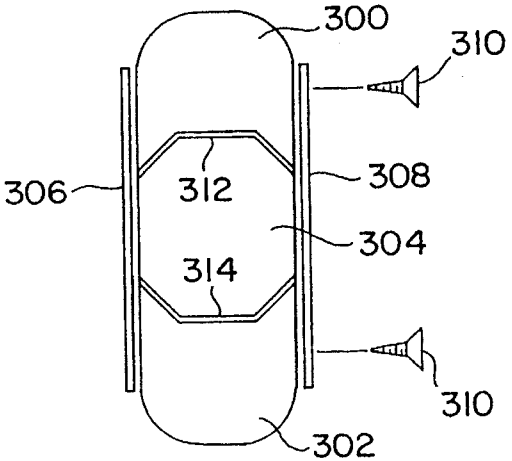
FIG. 18 is a cross-sectional view of the tennis racket handle kit of FIG. 17.

Turning now to FIGS. 17 and 18, the tennis racket handle configuration of FIGS. 9*a* and 9*b* can be implemented in another embodiment for use by tennis shops and tennis players alike, in which a pair of inserts 300 and 302 are mounted on a handle shaft 304 of a tennis racket. The inserts 300 and 302 in this kit are intended to be releasably attachable to the handle shaft or to a conventional sleeve mounted thereon. Preferably, a removable attachment interface, e.g. tape adhesive, is provided between the inner surfaces of the inserts 300, 302 and the handle shaft 304. To ensure that the inserts 300 and 302 are adequately secured to the handle shaft, a pair of side plates 306 and 308 can be mounted thereon using appropriate fasteners, such as the screws 310. Referring now to FIG. 18, the removable attachment interface is preferably placed in the areas shown by reference numbers 312 and 314. Preferably, the side plates 306 and 308 are as thin as possible. They can be made from a variety of materials such as plastic, aluminum, titanium, steel, etc. The implementation of the kit of FIGS. 17–18 is completed by wrapping the inserts 300, 302, and the remainder of the handle shaft 304, with an appropriate gripping tape.

Figure 19:
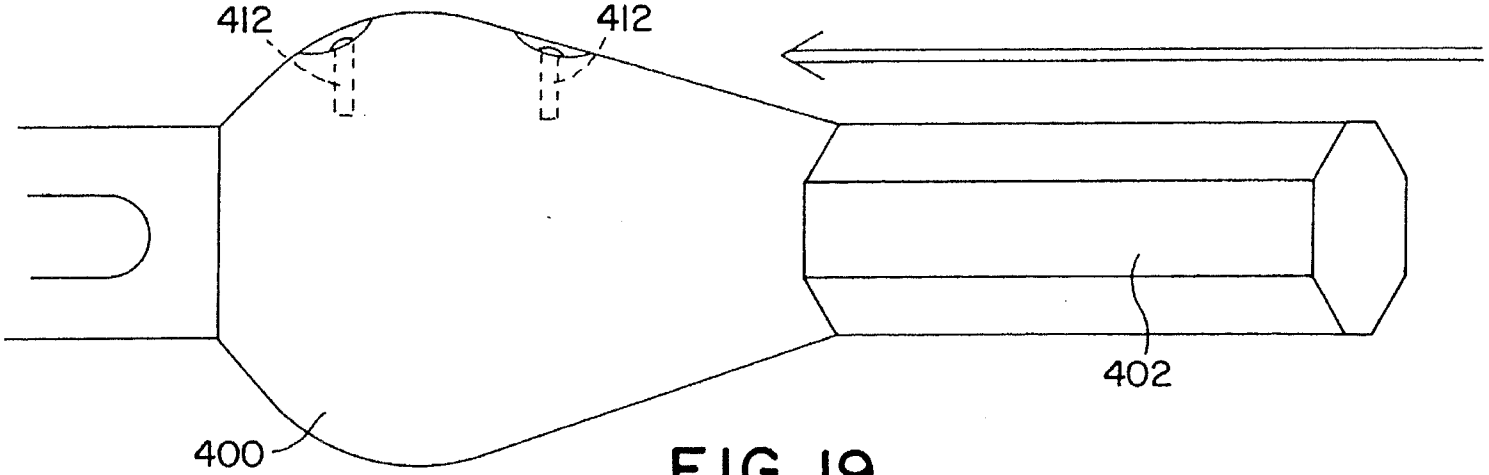
FIG. 19 is a partial perspective view showing still another embodiment of a tennis racket handle kit useful for fabricating the handle configuration of FIGS. 9*a* and 9*b*, and many other handle shapes.
Figure 20:
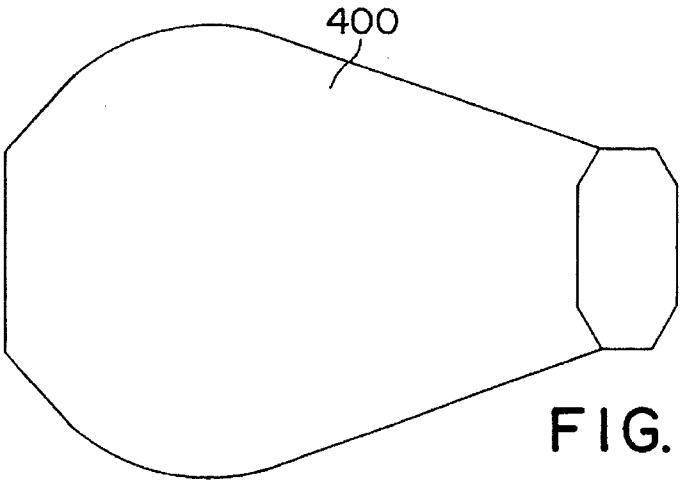
FIG. 20 is a perspective view of a sleeve component of the tennis racket handle kit of FIG. 19.
Figure 21:
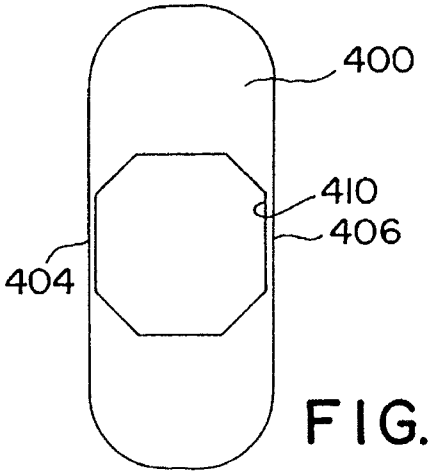
FIG. 21 is a cross-sectional view of the tennis racket handle kit sleeve component of FIG. 20.

Turning now to FIGS. 19–21, the tennis racket handle configuration of FIGS. 9*a* and 9*b* can be implemented in still another embodiment for use by tennis shops and tennis players in which a single sleeve 400 is sized and configured to mount over a handle shaft 402. As shown in FIG. 21, the sleeve 400 has a pair of side walls 404 and 406 which are made as thin as possible in order to maintain the ratio of depths d2/d1 as close as possible to unity. The sleeve 400 can be made from a variety of materials but is preferably made from a resilient or a semi-resilient material which can be stretched to accommodate different racket shaft sizes. Alternatively, the sleeve 400 can be made from a rigid material and sized such that its interior passage 410 is slightly larger than the handle shaft 402. Inserts (not shown) could be provided as desired to help positionally retain the sleeve 400 on the handle shaft. In addition, the sleeve 400, whether made from resilient or non-resilient material, can be secured to the lower handle shaft 402 using a pair of fasteners, such as the screws 412, which are threaded into the sleeve 400 and adjustably engagable against the handle shaft 402. The implementation of the kit of FIGS. 19–21 is completed by wrapping the insert 400, and the remainder of the handle shaft 402, with an appropriate gripping tape.

Figure 23:
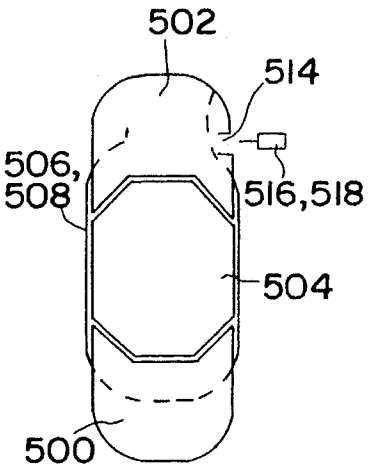
Figure 22:
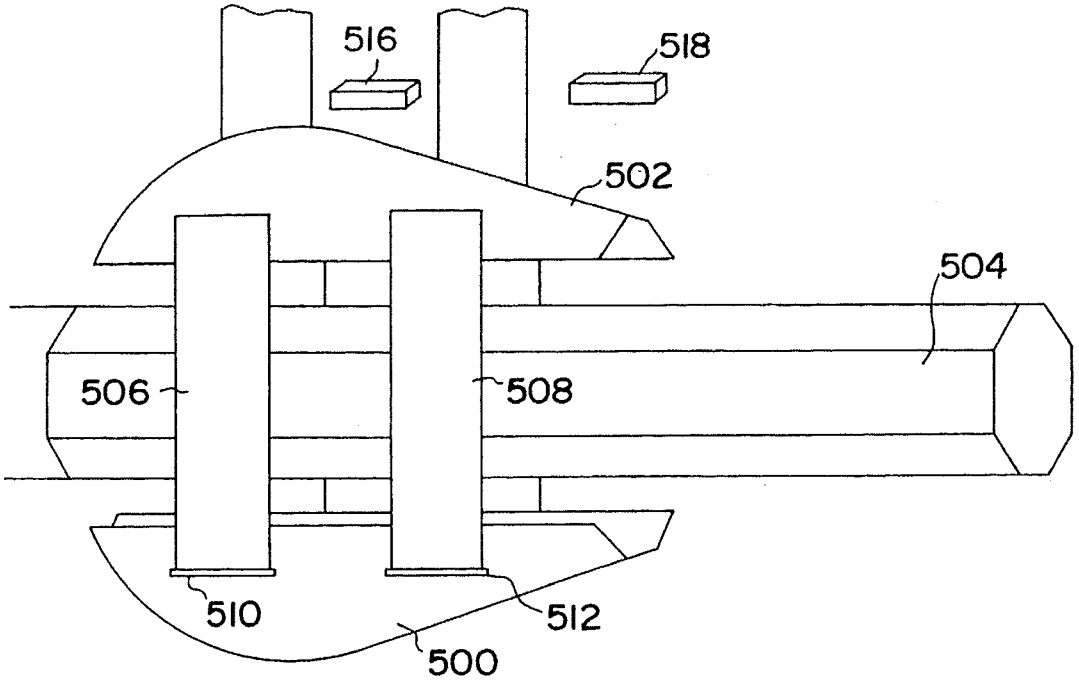
FIG. 22 is a cross-sectional view of a modification of the tennis racket handle kit sleeve component of FIG. 20.

Turning now to FIGS. 22–23, the tennis racket handle kit of FIGS. 9*a* and 9*b* could be implemented in another embodiment for by tennis shops or tennis players alike, in which a pair of rigid plastic inserts 500 and 502 are mounted on a handle shaft 504 of a tennis racket. The inserts 500 and 502 in this kit are intended to be releasably attachable to the handle shaft or to a conventional sleeve mounted thereon. The inserts 500 and 502 are secured to the handle shaft 504 using a pair of straps 506 and 508. The straps 506 and 508 are permanently attached at one end to the insert 502 using any suitable attachment arrangement, but are preferably molded into the insert 502 when it is fabricated. The straps 506 and 508 extend through slots 510 and 512 in the insert 500 and are thereafter removably secured to the insert 500 using any suitable attachment method. A preferred attachment method is to provide a pair of notches or channels, shown by reference number 514 in FIG. 23, into which the straps 506 and 508 are positioned following strap tightening. The straps are then retained in position in the notches or channels 514 using plugs 516 and 518 which fit snugly therein. Following plug placement, the straps may be trimmed as necessary to remove any excess material. The implementation of the tennis racket handle kit of FIGS. 22–23 is completed by wrapping conventional grip material over the inserts 500 and 502 and the remaining length of the handle shaft 504.

Figure 24:
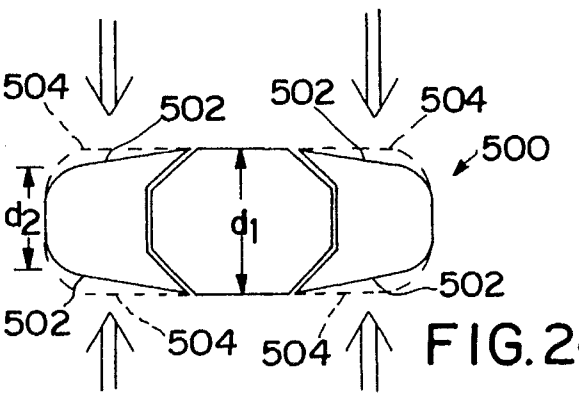

As previously described in connection with FIGS. 9*a* and 9*b*, it is desirable to provide a tennis racket handle configuration having an advertising area 114 which is relatively flat in order to accommodate the advertising indicia to be added. FIG. 24 illustrates an enlarged handle portion 500 having a depth which varies from a maximum of d1 to a minimum of d2 through a gradually tapering section 502. This taper can be effective in helping the enlarged handle portion 500 feel less bulky. A section 504 could be optionally provided to achieve a still flatter surface. Preferably the change in depth from the mid-point of the handle at d1 to the side of the handle at d2 should not exceed about ⅛–¼ inches per 1 inch of width, although personal preferences and a desire to limit handle bulkiness may dictate that additional taper be provided.

Figure 26:
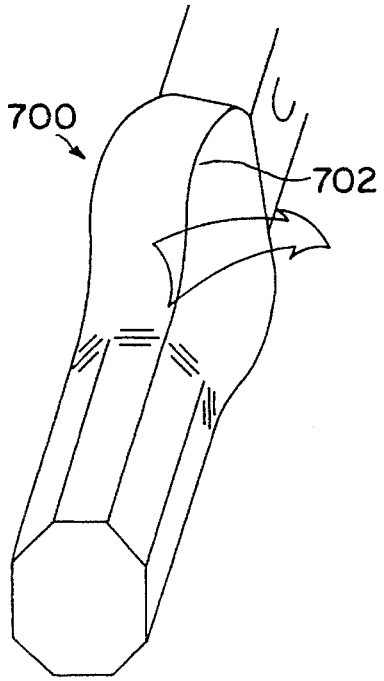
Figure 25:
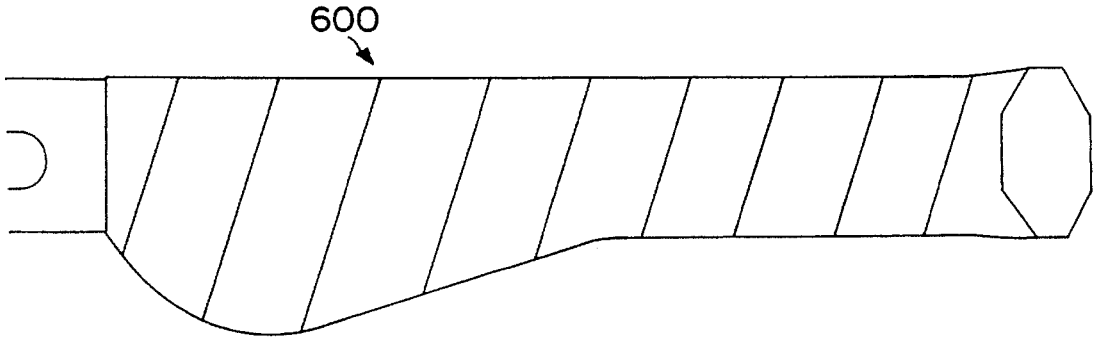

Accordingly, a novel tennis racket with enhanced handle kit has been described. While various embodiments have been disclosed, it should be apparent that many variations and alternative embodiments would be apparent to those skilled in the art in view of the teachings herein. For example, the handle inserts might simply be glued on to a conventional handle or handle sleeve using an appropriate adhesive that provides either a permanent or a temporary attachment. In other embodiments, a handle kit 600 such as that shown in FIG. 25 could be provided on the finger side of the handle only for players who want the feel of a normal racket on the side of the handle that engages the area of the hand between the thumb and forefinger. In still other embodiments, an enlarged handle portion 700 such as that shown in FIG. 26 could be slightly twisted in a counter-clockwise direction when viewing the handle from the butt of the racket, as indicated at reference number 702. Such a configuration would be used for right-handed players. Left-handed players would use a racket with an enlarged handle portion twisted in a clockwise direction. It is understood, therefore, that the invention is not to be limited except in accordance with the spirit of the appended claims and their equivalents.

I claim:

1. In a tennis racket having a racket head and a handle shaft extending from said racket head, said handle shaft having a substantially uniform first handle portion including a first width dimension and a substantially uniform first depth dimension, a pair of side walls, a pair of end walls substantially perpendicular to said side walls and two pairs of angled walls joining said side walls and end walls so as to form an octagonal cross section, an improved tennis racket handle kit, comprising:

a first structure forming an enlarged handle portion of said handle shaft having a second width dimension that is larger than said first width dimension and a second depth dimension;

a second structure forming a handle transition portion of said handle shaft between said first and second handle portions providing a transition between said first and second width dimensions, wherein said first and second structures are formed as one or more inserts mountable on opposing sides of said racket shaft, and wherein said inserts are generally rectangular strips having a width that is substantially equal to the width of said end walls; and a wrapping covering said first and second structures.

2. The tennis racket handle kit of claim 1 wherein said inserts are sized and configured to provide an advertising area on said enlarged handle portion.

3. The tennis racket handle kit of claim 1 wherein said inserts a thickness "t" providing an increase in size between said first width dimension and said second width dimension, said increase in size being substantially equal to "2×t."

4. The tennis racket handle kit of claim 1 wherein said inserts include a tapered end portion that provides said handle transition portion of said handle shaft.

5. The tennis racket handle kit of claim 1 wherein two or more inserts are mountable on each of said opposing sides of said racket shaft, the number of inserts being selected to provide a thickness "T=t1+t2 . . . +tn" where "n" is the number of inserts on a side and "t" is the thickness of each insert, and wherein the thickness "T" provides an increase in size between said first width dimension and said second width dimension.

6. The tennis racket handle kit of claim 1 wherein said inserts are bendable strips having a width that is substantially equal to the width of said end walls and the width of two of said angled walls, said bendable strips having angled edges configured to line up with said racket handle side walls when said bendable strips are placed over said end walls and angled walls.

7. The tennis racket handle kit of claim 6 wherein said inserts include a tapered end portion that provides said handle transition portion of said handle shaft.

8. The tennis racket handle kit of claim 1 wherein said inserts are resilient strips having three walls configured to mount on one of said racket handle end walls and two adjacent angled walls thereof, said rigid strips having angled edges configured to line up with said racket handle side walls when said resilient strips are placed over said end walls and adjacent angled walls.

9. The tennis racket handle kit of claim 8 wherein said inserts wherein said inserts include a tapered end portion that provides said handle transition portion of said handle shaft.

10. The tennis racket handle kit of claim 1 wherein said inserts have a thickness "t" providing a continuous increase in size from said first width dimension at a first end of said inserts to said second width dimension toward a second end of said inserts, said increase in size being substantially equal to "2×t."

11. The tennis racket handle kit wherein said inserts form a continuously changing width dimension diverging from a position proximate said base end to said maximum width dimension and converging to a position proximate said head end of said shaft, thereby forming a generally teardrop configuration.

12. A tennis racket handle kit for use on a tennis racket having a racket head and a racket handle shaft extending therefrom providing a first handle portion having a substantially uniform first width dimension and a substantially uniform first depth dimension, said tennis racket handle kit comprising:

a set of inserts mountable on opposing sides of said racket shaft, said inserts having selected thicknesses and being arrangeable in layers of one or more inserts on each of said opposing sides of said racket handle shaft to provide a second handle portion having a second width dimension that is larger than said first width dimension and a second depth dimension, and a handle transition portion between said first and second handle portions providing a transition between said first and second width dimensions, said increase in size between said first and second width dimensions being substantially equal to the combined thicknesses of said inserts, wherein said handle shaft includes a pair of side walls, a pair of end walls substantially perpendicular to said side walls and two pairs of angled walls joining said side walls and end walls so as to form a hexagonal cross section, and wherein said inserts are generally rectangular strips having a width that is substantially equal to said end walls.

13. The tennis racket handle kit of claim 12 wherein said inserts are sized and configured to provide an advertising area on said second handle portion.

14. The tennis racket handle kit of claim 12 wherein said inserts are bendable strips having a width that is substantially equal to the width of said end walls and the width of two of said angled walls, said bendable strips having angled edges configured to line up with said racket handle side walls when said bendable strips are placed over said end walls and angled walls.

15. The tennis racket handle kit of claim 14 wherein said inserts include a tapered end portion that provides said handle transition portion.

16. The tennis racket handle kit of claim 12 wherein said inserts are resilient strips having three walls configured to mount on one of said racket handle end walls and two adjacent angled walls thereof, said rigid strips having angled edges configured to line up with said racket handle side walls when said resilient strips are placed over said end walls and adjacent angled walls.

17. The tennis racket handle kit of claim 12 wherein said inserts wherein said inserts include a tapered end portion that provides said handle transition portion.

18. The tennis racket handle kit of claim 12 wherein said inserts have a thickness "t" providing a continuous increase in size from said first width dimension at a first end of said inserts to said second width dimension toward a second end of said inserts, said increase in size being substantially equal to "2×t."

19. The tennis racket handle kit of claim 12 wherein said inserts form a continuously changing width dimension diverging from a position proximate said base end to said maximum width dimension and converging to a position proximate said head end of said shaft, thereby forming a generally teardrop configuration.

20. In a tennis racket having a racket head and a handle shaft extending from said racket head, said handle shaft having a head end and a base end and a substantially uniform first handle portion including a first width dimension and a substantially uniform first depth dimension, an improved tennis racket handle kit, comprising:

a structure forming an enlarged handle portion of said handle shaft having a second width dimension that is larger than said first width dimension and a second depth dimension; and said structure forming a handle transition portion of said handle shaft to said enlarged handle portion beginning proximate said base end and providing a gently outwardly diverging transition between said first and second width dimensions, said structure forming a continuously changing width dimension from a position proximate said base end to said second width dimension toward said head end and converging back to said first width dimension at a position proximate said head end of said shaft.

21. The tennis racket handle kit of claim 20 wherein said first structure is formed as a sleeve that is mountable on said handle shaft.

22. The tennis racket handle kit of claim 21 wherein said sleeve is a resilient member that is shaped to define said first and second enlarged handle and handle transition portions of said handle shaft.

23. The tennis racket handle kit of claim 20 wherein said structure forms a continuously changing width dimension diverging gradually from a position proximate said base end to said maximum width dimension and then converging rapidly to a position proximate said head end of said shaft, thereby forming a generally teardrop configuration.

24. The tennis racket handle kit of claim 23 wherein said structure is formed as a pair of inserts mountable on opposing sides of said racket shaft.

* * * * *